United States Patent [19]

DiMarco et al.

[11] 4,214,219

[45] Jul. 22, 1980

[54] PUSH-PUSH SWITCH

[75] Inventors: Bernard DiMarco; John C. Hempstead, both of Bellefontaine, Ohio

[73] Assignee: Gould Inc., Rolling Meadows, Ill.

[21] Appl. No.: 901,081

[22] Filed: Apr. 28, 1978

[51] Int. Cl.[2] ..... H01H 73/48; H01H 75/00; H01H 77/00

[52] U.S. Cl. ..... 335/23; 335/35; 335/39; 337/66

[58] Field of Search ..... 335/23, 35, 39, 41; 337/66

[56] References Cited

U.S. PATENT DOCUMENTS

| | | | |
|---|---|---|---|
| 2,611,052 | 9/1952 | Platz et al. | 335/35 X |
| 3,075,058 | 1/1963 | Platz et al. | 335/35 |
| 3,193,643 | 7/1965 | Hollyday | 335/41 X |

*Primary Examiner*—Fred L. Braun

*Attorney, Agent, or Firm*—Ostrolenk, Faber, Gerb & Soffen

[57] ABSTRACT

A switch which is opened and closed by successively depressing a manual operating handle is provided with one spring for separating the switch contacts and a separate spring for closing the switch contacts. Interrupting capacity is improved without increasing overall size by utilizing a J-shaped movable contact arm mounted on a pivot located a substantial distance from the movable contact. The closing spring is located adjacent to the arcing or interrupter area. A metal shield is positioned to protect the closing spring from hot arcing gases as they exit from the interrupter area. The speed of instantaneous or magnetic tripping is improved by providing the magnet coil with at least one complete current carrying loop.

12 Claims, 6 Drawing Figures

PUSH-PUSH SWITCH

This invention relates to circuit breakers in general and more particularly relates to so-called push-push type circuit breakers in which by successively depressing a manual operating handle the contacts are operated both into and out of engagement.

Push-push type circuit breakers are described in U.S. Pat. No. 2,385,727 issued Sept. 25, 1945 to E. E. Platz for a Switch and in U.S. Pat. No. 2,938,983 issued May 31, 1960 to R. W. Thomas for a Circuit Breaker Latch. These circuit breakers are intended for domestic and light industrial applications, and considering their interrupting ratings, these circuit breakers are relatively compact. Within the same general overall dimensions required for prior art devices, the instant invention provides a circuit breaker of substantially increased interrupting rating.

In part, this is accomplished by providing separate springs for contact opening and closing, whereas the prior art utilized the same spring for both functions. In addition the movable contact arm has the pivot therefor moved much further from the movable contact than in prior art designs. In addition, metal shielding is provided to protect the contact closing spring from hot gases generated by arcs created during contact separation.

Accordingly, a primary object of the instant invention is to provide an improved construction for a so-called push-push type circuit breaker.

Another object is to provide a circuit breaker of this type which, for a given case size, has a substantially higher interrupting capacity than similar circuit breakers of the prior art.

A still further object is to provide a circuit breaker of this type having one spring for providing closing forces and a separate spring for providing opening forces.

These objects as well as other objects of this invention shall become readily apparent after reading the following description of the accompanying drawings in which:

In FIG. 3 the circuit breaker contacts are closed and in FIG. 4 they are open.

Figure 2:
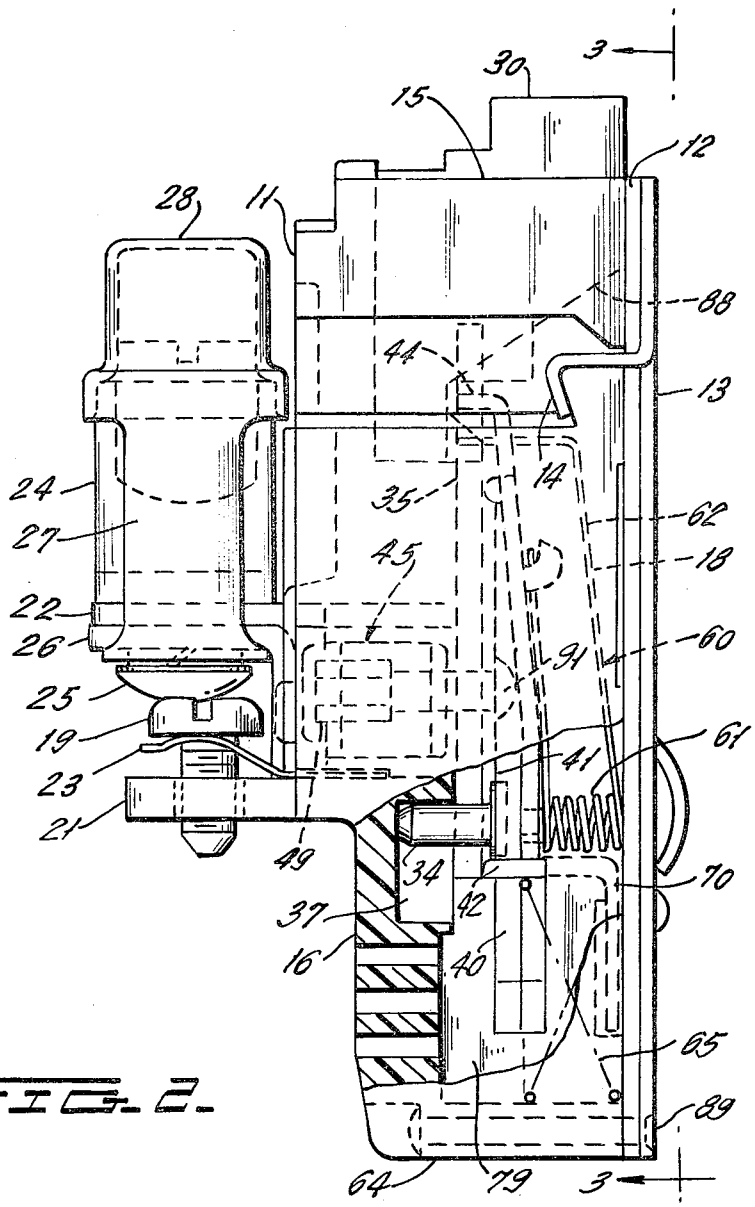
FIG. 2 is an elevation of the circuit breaker of FIG. 1 looking in the direction of arrows 2—2 of FIG. 1.
Figure 1:
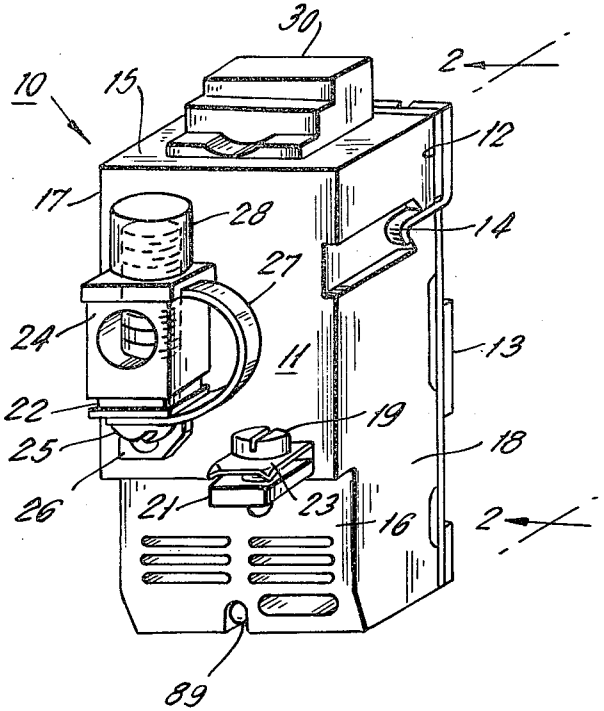
FIG. 1 is a perspective of a single pole circuit breaker constructed in accordance with teachings of the instant invention.

Now referring to the Figures. Single pole circuit breaker 10 is of the so-called push-push type described in the aforesaid U.S. Pat. Nos. 2,385,727 and 2,938,983. The circuit breaker housing consists of hollow molded insulating base 11 having an open side which is closed by sheet-like insulating cover 12 which is retained by metal sheet 13 having hooks 14 which engage cooperating formation of base 11, and a rivet 89. The latter includes front 15, side wall 16 opposite the open side of base 11, and opposed end walls 17, 18 along opposite sides of side wall 16. The latter is provided with openings through which portions of line and load terminal members 21, 22, respectively, extend. Line terminal screw 19, mounted to spring retainer 23, extends through a clearance aperture in line terminal 21 for engagement with a threaded aperture (not shown) in a panelboard conductor. Wire grip 24 is mounted to the front surface of load terminal 22 by retaining screw 25 which extends through a clearance aperture in L-shaped stabilizer bracket 26. Flexible extension 27 of removable plastic cap 28 has its free end sandwiched between the head of screw 25 and member 26.

Front 15 is provided with an aperture through which manual operating handle 30 extends. The latter is a molded plastic member biased in a forward direction by coiled compression spring 31. As handle 30 is depressed from its fully extended off position of FIG. 4, formation 32 thereof moves into notch 33 of insulating carrier 35 to drive the latter rearward. Pin 34 extends through clearance aperture 36 in support 35 and also into elongated slot 37 in the interior surface of base side wall 16 to pivotally mount support 35 and also permit linear motion thereof. Pin 34 extends transversely through generally J-shaped movable contact arm or contactor 40, being fixedly secured to the latter. The J-shaped contactor 40 is constructed of a generally straight first arm portion which is above pivot pin 34 and a U-like second arm portion which is below and to the left of pivot 34 as shown in FIG. 5.

Contactor 40 together with elongated bimetal strip 41 and movable contact 42 form contactor assembly 50. The rear end of bimetal 41 is fixedly secured to contactor 40 and the front end of bimetal 41 is bent toward side wall 16 and generally parallel to the pivot axis provided by pin 34 to form latch 44. The short section 90 of contactor 40 adjacent movable contact 42 is of double thickness to stabilize contact 42. In a manner to be explained, the latter is engageable with and disengageable from stationary contact 43 mounted on line terminal member 21.

Flexible conducting braid 46 connects bimetal 41 to one end of coil or loop 47 whose other end is connected to load terminal member 22. Coil 47 is the energizing turn for instantaneous magnetic trip means 45 which also includes magnetic frame member 48 and movable tubular armature 49 which receives the small diameter end of plunger pin 91. As will hereinafter be seen, tripping action takes place when armature 49 moves toward cover 12 driving pin 91 into engagement with bimetal 41 of contactor assembly 50.

Torsion spring 60 includes multiturn central portion 61 mounted on pivot pin 34. The turns of section 61 are normally spaced from one another. However, when assembled in circuit breaker 10, central section 61 is compressed between cover 12 and contactor 40 thereby biasing assembly 50 toward base wall 16. This also biases latch 44 towards its latched or holding position of FIG. 3 adjacent rolled edge 59 of plate 58 riveted to carrier 35. The elongated end portions 62, 63 of spring 60 are connected to support 35 and contactor 40, respectively, thereby biasing assembly 50 counterclockwise with respect to support 35 as the elements of circuit breaker 10 are viewed through the open side of base 11.

Coiled compression spring 65 has its rear end bearing against foot 67 of stationary shield member 66 formed of sheet metal. Foot 67 is seated in depression 68 in the interior surface of base rear wall 64. Main section 69 of member 66 extends for a substantial distance along the side of spring 65. The forward end of spring 65 bears against foot 71 of movable metal shield member 70 with the main section 72 of member 70 extending for a substantial length along the side of spring 65. Forward extension 73 of foot 71 is provided with arcuate notch 74 which receives pivot pin 34. Thus, the forwardly directed force generated by spring 65 acts against pivot pin 34 urging it to move forward in guide slot 37.

Molded arc barrier 80 confronts front wall 16 being spaced therefrom to partially define arc chamber 79 wherein movable contact 42 travels. Edge 81 of barrier 80 is adjacent to a portion of main section 69 to stabilize the position of shield member 66.

As explained in detail in the aforesaid U.S. Pat. Nos. 2,385,727 and 2,938,983, forward movement of handle 30 is limited by engagement of handle ledge 82 with an interior surface of base 11. This fully extended position is the Off or Open position of FIG. 4. In the Closed or On position of FIG. 3, handle 30 is held in an intermediate position by pawl formation 83 of support 35 which is positioned in front of handle ledge 84. The cutout in support 35 between pawl 83 and latching surface 59 provides clearance for handle formation 32 during the opening stroke which will be hereinafter explained and also provides clearance for positioning latch 44 to cooperate with latch surface 59.

Circuit breaker 10 operates in the following manner. With the circuit breaker elements in the Off position of FIG. 4, latch 44 is unlatched and contact opening spring 60 has pivoted contactor assembly 50 counterclockwise. At the same time contact closing spring 65 applies a biasing force which maintains pivot pin 34 at the forward end of guide slot 37 and the lower end of bimetal 41 abuts surface 86 projecting inwardly from the inner surface of side wall 16.

Figure 4:
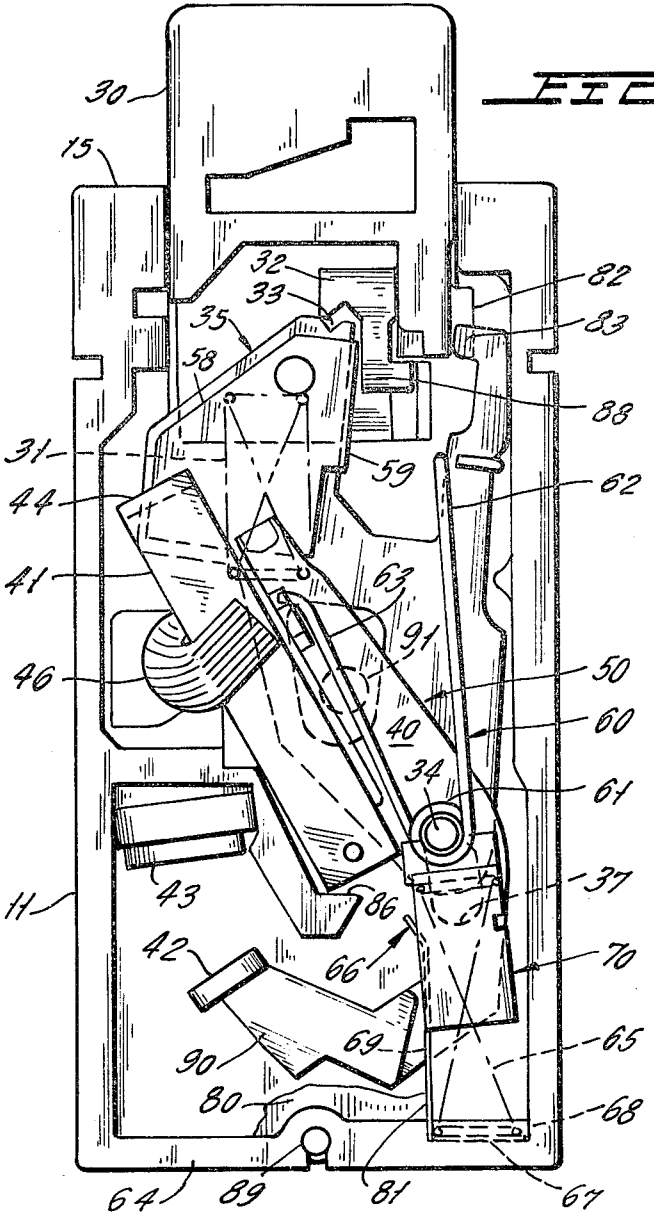
FIGS. 3 and 4 are elevations looking in the direction of arrows 3—3 of FIG. 2 with the housing cover removed.
Figures 5, 6:
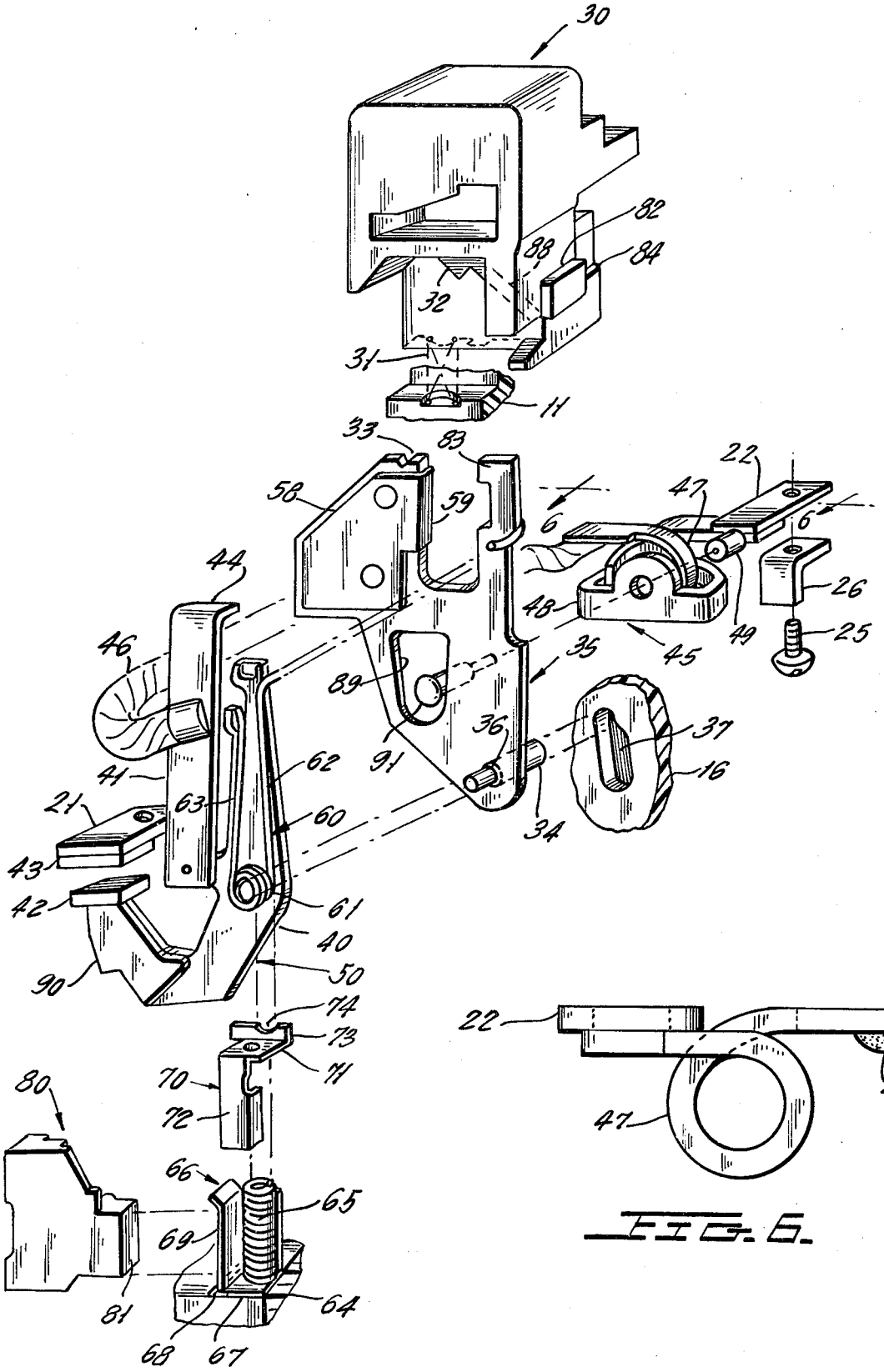
FIG. 5 is an exploded perspective of the main operating elements.
FIG. 6 is an end view of the instantaneous trip coil looking in the direction of arrows 6—6 of FIG. 5.

As operating handle 30 is depressed from its fully extended position of FIG. 4, handle formation 32 enters support notch 33 and continued rearward movement of handle 30 moves support 35 rearward which in turn moves pivot pin 34 to the rear. This motion of pin 34 causes clockwise pivoting of contactor assembly 50 in that the lower end of bimetal 41 rests against abutment 86. During this pivoting motion of assembly 50, latch 44 rides across the surface of plate 58 moving to the right with respect to FIG. 4. When the left edge of latch 44 moves to the right of latching surface 59, compression section 61 of spring 60 moves latch 44 toward wall 16 and latch 44 is now positioned so that counterclockwise movement thereof is blocked by edge 59, being biased thereagainst by the torsion action of spring 60. Upon release of handle 30, it moves forward under the influence of return spring 31. At the same time contact closing spring 65 acts to move pivot pin 34 forward in guide slot 37 so that assembly 50 and support 35 also move forward. When pin 34 nears the upper end of slot 37, movable contact 42 engages stationary contact 43. The inclined face of stationary contact 43 serves to direct assembly 50 counterclockwise as pivot 34 moves to the forward end of slot 37. This motion of assembly 50 is transmitted through latch 44 to move support 35 counterclockwise to the position illustrated in FIG. 3. This motion is permitted in that handle formation 32 has moved clear of notch 33.

Figure 3:
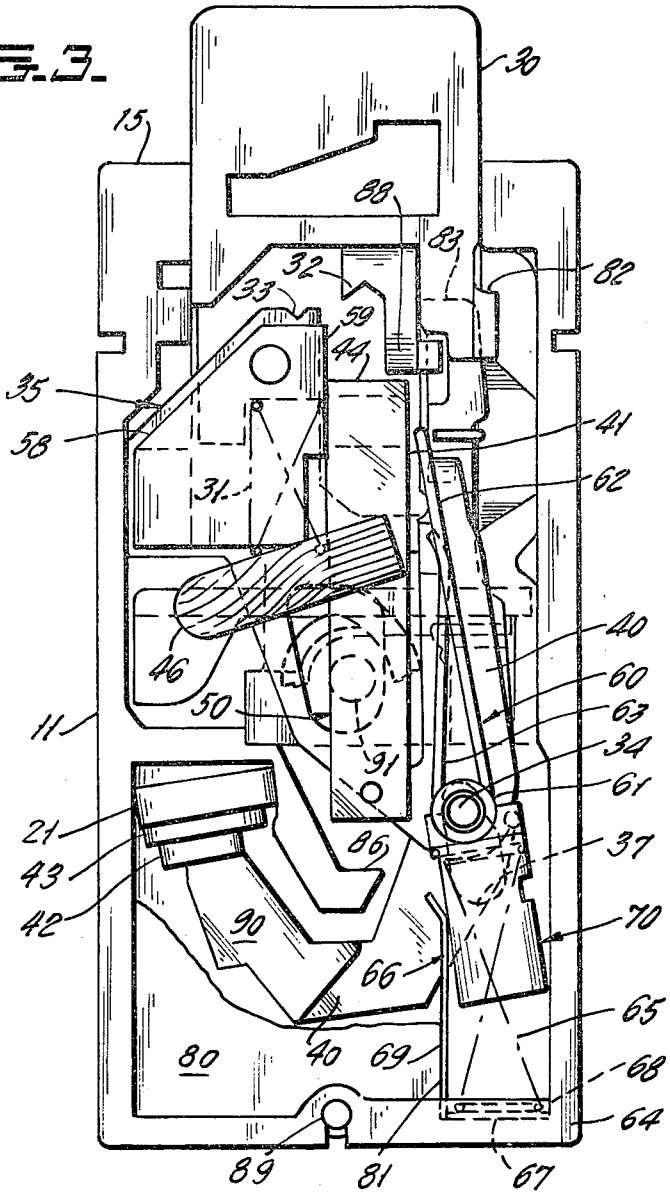

In the On position of FIG. 3, handle formation 32 is to the right of latching edge 59 so that subsequent rearward motion of handle 30 will not force support 35 rearward. However, inclined camming surface formation 88, formed integrally with handle 30, is aligned with latch 44 so that as handle 30 moves rearward from the position of FIG. 3 cam surface 88 engages latch 44 and moves the latter away from side wall 16. When latch 44 moves clear of latching surface 59 the torsion action of opening spring 60 moves assembly 50 very rapidly in a counterclockwise direction to the open circuit position wherein there is a substantial separation between movable and stationary contacts 42, 43. At the same time spring 60 pivots support 35 in a clockwise direction to the position shown in FIG. 4 wherein handle formation 32 is positioned for entry into support member notch 33 when handle 30 is next depressed.

With circuit breaker 10 in the On position of FIG. 3, moderate overloads will cause deflection of bimetal 41 with the latch portion 44 thereof moving away from side wall 16. Once latch 44 clears edge 59 spring 60 pivots assembly 50 in a counterclockwise direction to separate movable contact 42 from stationary contact 43. Upon the occurrence of severe overload conditions the current through energizing turn 47 of magnetic trip means 45 drives armature 49 away from side wall 16, propelling the plunger pin 91 through window 89 of support 35 into engagement with bimetal 41 to move the latter against the biasing force of spring section 61 until latch 44 moves clear of edge 59 and permits the torsion action of spring 60 to separate movable contact 42 from stationary contact 43.

The sensitivity of magnetic trip means 45 is enhanced by providing coil 47 with a minimum of one complete closed, though not shorted, loop. It is noted that turn 47 is formed of relatively stiff sheet material and is not insulated.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A switch including relatively movable and stationary contacts; a mechanism for operating said movable contact into and out of engagement with said stationary contact; a housing wherein said contacts and said mechanism are disposed; said housing including a front, opposed side walls extending rearward from said front, and opposed end walls connecting said side walls along opposite edges thereof; said mechanism including a rearwardly depressible portion extending through an opening in said front; first means biasing said portion forward; said mechanism including support means, a contactor assembly mounted on said support means for movement relative thereto between a reset and a tripped position, latch means for normally holding said assembly in said reset position, said assembly including said movable contact, first spring means biasing said movable contact toward engagement with said stationary contact when said assembly is in said reset position, another spring means biasing said assembly toward said tripped position to separate said movable contact from said stationary contact when said latch means releases said assembly; release means operable to release said latch by depressing said portion when said assembly is in said reset position; and automatic trip means operable to release said latch upon the occurrence of predetermined fault conditions.

2. A switch as set forth in claim 1 in which the assembly includes a contactor comprising a first arm and a second arm extending from said first arm transverse thereto; said movable contact being mounted on said second arm at the end thereof remote from said first arm; pivot means on which said assembly moves between said reset and tripped positions; said pivot means being located generally at the junction between said first and second arms.

3. A switch as set forth in claim 2 in which the second arm is generally U-like in shape.

4. A switch as set forth in claim 2 in which the first arm is generally straight and the contactor is generally J-like in shape.

5. A switch as set forth in claim 1 in which said another spring means also biases the latch toward position for holding said contactor in said reset position.

6. A switch as set forth in claim 1 in which said another spring means comprises a single formed wire element having a torsion section biasing said assembly toward said tripped position and a compression section biasing said latch toward position for holding said contactor in said reset position.

7. A switch as set forth in claim 6 including pivot means on which said assembly moves between said reset and tripped positions; said compression section comprising a plurality of turns surrounding said pivot means.

8. A switch as set forth in claim 1 also including shield means interposed between said contacts and said first spring means to protect the latter against destructive effects generated by arcs drawing between said contacts during separation thereof.

9. A switch as set forth in claim 8 in which the shield means includes a stationary element and a movable element; said first spring means being a coiled compression member having its opposite ends bearing against said elements.

10. A switch as set forth in claim 9 including pivot means on which said assembly moves between said reset and tripped positions; said first spring means acting through said movable element to bias said pivot means forward.

11. A switch as set forth in claim 1 in which the assembly includes a contactor in which said movable contact is mounted, said automatic trip means including a bimetal strip constituting a part of said assembly; said strip having one end anchored relative to said contactor and having said latch at the other end thereof; another automatic trip means operable to release said latch upon the occurrence of other predetermined fault conditions more severe than those predetermined fault conditions which operate said automatic trip means; said another automatic trip means including at least one complete current carrying loop constructed of a relatively rigid flat conductor.

12. A switch as set forth in claim 1 in which the assembly and the support means are mounted for relative movement about a pivot axis; said first spring means including a coiled member generating a force directed along a line positioned relatively close to said pivot axis.

* * * * *